US006733589B2

(12) United States Patent
Tobisawa

(10) Patent No.: US 6,733,589 B2
(45) Date of Patent: May 11, 2004

(54) EXTRUDING COATING METHOD AND EXTRUDING COATING APPARATUS

(75) Inventor: Seiichi Tobisawa, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/797,240

(22) Filed: Mar. 1, 2001

(65) Prior Publication Data

US 2001/0027746 A1 Oct. 11, 2001

(30) Foreign Application Priority Data

Mar. 13, 2000 (JP) ..... 2000-068543

(51) Int. Cl.[7] ..... B05C 3/02

(52) U.S. Cl. ..... 118/410; 427/356; 427/600; 425/461; 425/467

(58) Field of Search ..... 427/356, 600; 118/410; 425/461, 467

(56) References Cited

U.S. PATENT DOCUMENTS 3,227,136 A 1/1966 Bartlett et al.
3,912,436 A 10/1975 Bailly
2002/0046697 A1 * 4/2002 Suszynski ..... 118/314

FOREIGN PATENT DOCUMENTS

| | | |
|---|---|---|
| DE | 19947658 | 6/1997 |
| JP | 9164357 | 6/1997 |
| JP | 09-164357 * | 6/1997 |

OTHER PUBLICATIONS

European Search Report EP 01 10 4582 * 1 sheet of Patent Abstracts of Japan English Translation.

* cited by examiner

*Primary Examiner*—Katherine A. Bareford
(74) *Attorney, Agent, or Firm*—Muserlian, Lucas and Mercanti

(57) ABSTRACT

An extruding coating method comprises steps of feeding a coating liquid into a coating liquid reservoir section provided with a slit having a slit width; and extruding the coating liquid through the slit so as to conduct coating, wherein the coating liquid is extruded through the slit by pushing the coating liquid in the coating liquid reservoir toward all over the slit width by a piston.

7 Claims, 2 Drawing Sheets

FIG. 1 (1)
PRIOR ART
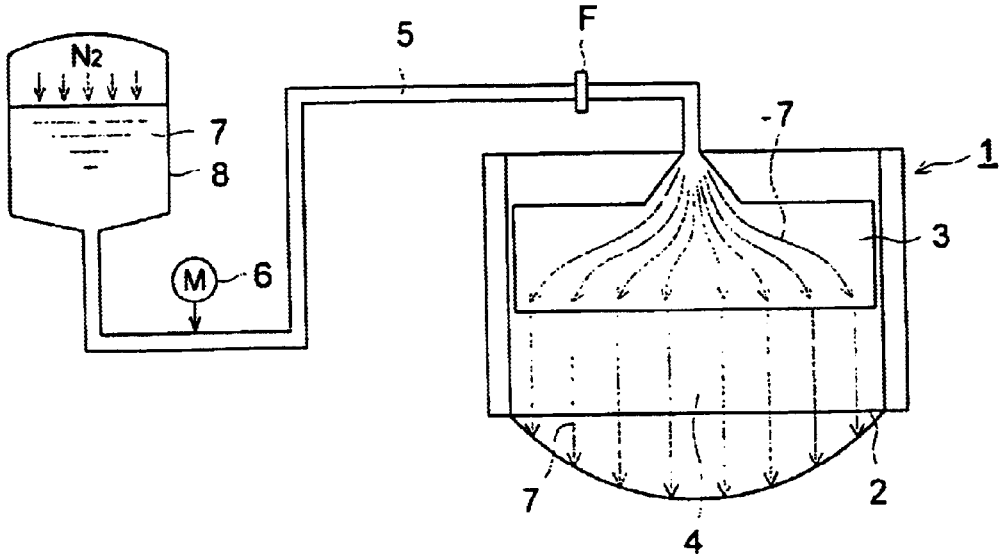
FIG. 1 (2)
PRIOR ART
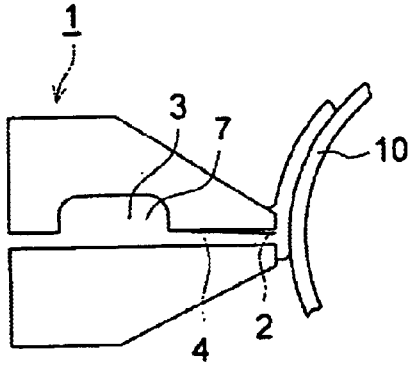

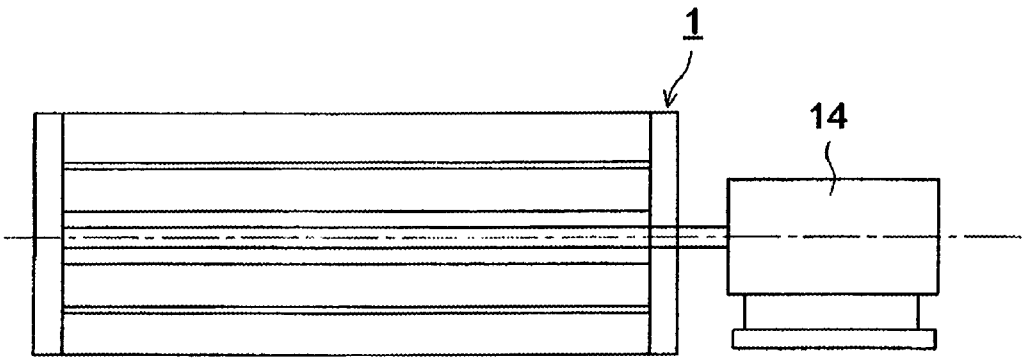
FIG. 2 (1)
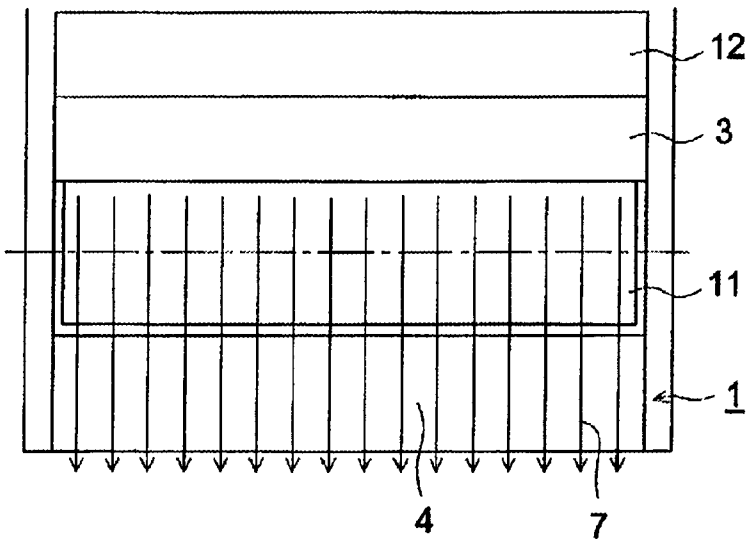
FIG. 2 (2)
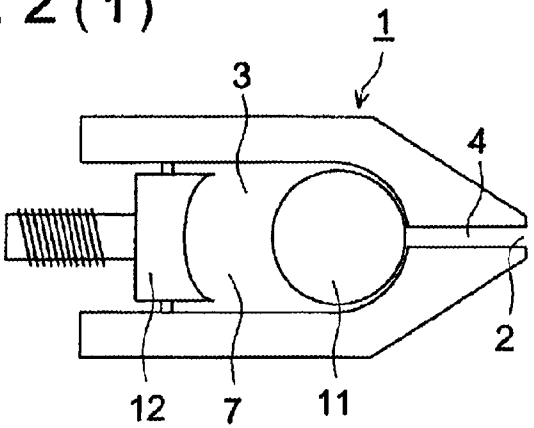
FIG. 2 (3)
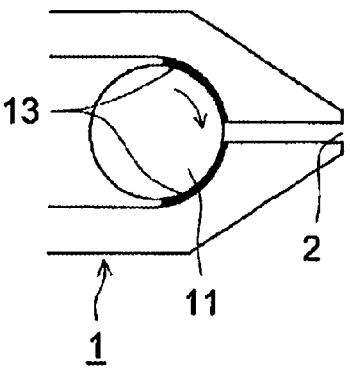

EXTRUDING COATING METHOD AND EXTRUDING COATING APPARATUS

BACKGROUND OF THE INVENTION

The present invention relates to a coating method and a coating apparatus used for manufacturing stimulable phosphor plates, silver halide light-sensitive materials and magnetic recording materials.

For manufacturing a large quantity of recording materials such as stimulable phosphor plates, silver halide light-sensitive materials and magnetic recording materials, there are used coating processes for forming various types of layers having various types of functions and characteristics.

These layers to be formed have been highly required to be thin in thickness and to be small in dispersion in recent years, for raising performance of recording materials. Further, not only coating at high speed but also a loss of coating liquids in a small amount and coping with production for many types in small output of products have been required.

On the other hand, examples of a coating method and a coating apparatus laid open to public inspection lately include the following. TOKKAIHEI No. 8-206565, for example, discloses a technology to overcome the situation wherein a change of a chamber fluidity in an extrusion type coating apparatus makes it impossible for the ordinary extrusion type coating apparatus to distribute coating liquids evenly in the lateral direction, when a type of coating liquid with high viscosity is changed, or physical properties of liquids are changed. The technology is represented by a coating apparatus wherein a spare chamber is provided to be ahead of a chamber, then, a plurality of fluidity distribution valves are provided in the spare valve to adjust fluidity, and thereby, coating liquids are distributed evenly in the lateral direction of the coater to make a coating thickness to be uniform. Further, TOKKAIHEI No. 10-8003 discloses a coating method wherein a rotary screw-shaped object is provided in a liquid dam of two roll coaters, for improving fluidity of coating liquids, and coating is conducted while the screw-shaped object is rotated.

In the technologies mentioned above, a uniform coating thickness can be obtained for sure if adjustment is made properly, even when characteristics of a coating liquid are changed in the course of coating operations. However, adjustment of flow rate is complicated, and it is sometimes impossible to obtain a desired layer thickness and accuracy distribution for dispersion of the layer thickness, depending on the state of coating liquids, if the rate of aperture of the valve is constant from the beginning to the end of coating. In addition, an amount of loss of coating liquids is large because a chamber section is greater, compared with a former coating apparatus, valve adjustment requires a longer period of time at the start of coating, and amount of loss of coating liquids on that portion is large. Further, when conducting coating, if a shearing speed at a certain extent needs to be applied immediately before coating, there is caused a problem that coating quality is not satisfactory.

On that point, it is possible for the technology in the latter case to apply shearing speed to coating liquids and to coat while maintaining satisfactory characteristics of coating liquids. However, the basic system of that technology is not an extrusion type coating system, and it is difficult to obtain satisfactory coating quality in terms of accuracy of a coating thickness accordingly.

SUMMARY OF THE INVENTION

The invention has been achieved to solve the problems stated above.

Namely, an object of the invention is to provide a coating method and a coating apparatus wherein a coating thickness is uniform, a size of its dispersion is small, an amount of loss of coating liquids is extremely small, which makes cost reduction possible, a coated surface can be made to be excellent because shearing speed can be applied to coating liquids immediately before coating, and space saving can be attained because a coater section is of an integral type.

The objects of the invention are attained by employing either one of the following methods and structures.

(1-1) An extruding coating method comprises steps of:

feeding a coating liquid into a coating liquid reservoir section provided with a slit having a slit width; and extruding the coating liquid through the slit so as to conduct coating, wherein the coating liquid is extruded through the slit by pushing the coating liquid in the coating liquid reservoir toward all over the slit width by a piston.

(1-2) In the extruding coating method of (1-1), the extruding coating method further comprises a step of:

applying a shearing speed to the coating liquid in the coating liquid reservoir section.

(1-3) In the extruding coating method of (1-1), the piston has a plane section which is parallel to the slit and has a length not shorter than the slit width and the piston pushes the coating liquid with the plane section.

(1-4) In the extruding coating method of (1-1), the piston pushes the coating liquid at a constant speed.

(1-5) In the extruding coating method of (1-1), a concentration of solid components in the coating liquid is 20 vol % or more.

(1-6) An extruding coating apparatus, comprises:

a coating solution feeding section to feed a coating liquid;

a coating solution reservoir section provided with a slit having a slit width and to store the coating liquid fed by the coating liquid feeding section; and a piston to push the coating liquid in the coating liquid reservoir section toward all over the slit width so as to extrude the coating liquid through the slit.

(1-7) In the extruding coating apparatus of (1-6), the extruding coating apparatus further comprises:

a shearing speed applicator to apply an equal shearing speed all over the slit width to the coating liquid in the coating liquid reservoir section.

(1-8) In the extruding coating apparatus of (1-7), the shearing speed applicator is a rotatable roller provided in the vicinity of the slit in the coating liquid reservoir section.

(1-9) In the extruding coating apparatus of (1-7), the shearing speed applicator is a ultrasonic wave emitting device to emit ultrasonic waves toward the coating liquid in the coating liquid reservoir section.

(1-10) In the extruding coating apparatus of (1-6), the piston has a plane section which is parallel to the slit and has a length not shorter than the slit width and the piston pushes the coating liquid with the plane section.

(1-11) In the extruding coating apparatus of (1-6), the piston pushes the coating liquid at a constant speed.

(1-12) In the extruding coating apparatus of (1-6), a concentration of solid components in the coating liquid is 20 vol % or more.

(1-13) A coater, comprises:

a coating solution reservoir section provided with a slit having a slit width and to store a coating liquid; and a piston to push the coating liquid in the coating liquid reservoir section toward all over the slit width so as to extrude the coating liquid through the slit.

Further, the above object may be attained by the following preferable method and apparatus.

(2-1) An extrusion type coating method for coating by distributing coating liquids injected in a coating liquid reservoir section having a slit with a desired width to cover a desired width, wherein a pressurization ram forces in and conveys coating liquids through the entire area of the slit in its width direction for coating.

(2-2) An extrusion type coating apparatus provided with a coating liquid reservoir section having a slit with a desired width and a pressurization ram for forcing in and conveying coating liquids through the entire area of the slit in its width direction, wherein coating liquids injected in the coating liquid reservoir section are distributed uniformly over the desired width for coating.

(2-3) The extrusion type coating apparatus according to (2-2), wherein a rotary roll is provided in the vicinity of the slit having the desired width in the coating liquid reservoir section of the extrusion type coating apparatus, and there is proved a mechanism that applies to coating liquids shearing speed that is uniform in the direction of the width.

The invention relates to an extrusion type coating method and an extrusion type coating apparatus. The extrusion type coating apparatus is a coating apparatus which can coat uniformly on a support an amount of coating liquids equivalent to a prescribed coating thickness, and it is a coating system excellent in terms of layer thickness distribution and coating stability and it is a typical method of the measuring coating system, although it requires mechanical accuracy. A coater in this system is a part of the coating apparatus, and it is a portion where the coating liquid to be coated on a support finally is ejected.

BRIEF DESCRIPTION OF THE DRAWINGS

FIGS. 1(1) and 1(2) are structural diagrams of an example of a conventional coating apparatus.

FIGS. 2(1), 2(2) and 2(3) are structural diagrams of an example of an extrusion type coating apparatus of the invention.

DETAILED DESCRIPTION OF THE PREFERRED EMBODIMENT

An extrusion type coating method of the invention includes a step to inject coating liquids in a coating liquid reservoir section having a slit and a step to force out the coating liquids from the slit and to coat on a support. Coating liquids in the coating liquid reservoir section are forced in through the entire area of the slit in its width direction by a piston (hereinafter referred to also as a pressurization ram), and are forced out from the slit.

An extrusion type coating apparatus of the invention has therein a coating liquid supply section that supplies coating liquids and a coating liquid reservoir section where coating liquids supplied by the coating liquid supply section are accumulated, and the coating liquid reservoir section has a slit. There is provided a piston that forces in coating liquids contained in the coating liquid reservoir section through the entire area of the slit in its width direction, and forces out the coating liquids from the slit.

A coater of the invention has a coating liquid reservoir section where coating liquids are accumulated, And the coating liquid reservoir section has a slit. There is provided a piston that forces in coating liquids contained in the coating liquid reservoir section through the entire area of the slit in its width direction, and forces out the coating liquids from the slit.

Incidentally, the direction of the slit in its width direction is its longitudinal direction. For example, when coating liquids are coated on a support that is conveyed, the direction of the slit in its width direction is a direction that is the same as the width direction of the support (namely, the direction perpendicular to the conveyance direction). It is preferable that a length of the width of the slit is the same as that of the width of the finished product after coating, and it may also be longer than that.

It is preferable that the piston forces in coating liquids uniformly through the entire area of the slit in its width direction. Namely, it is preferable that coating liquids are forced in by the piston so that coating liquids are distributed uniformly through the entire area of the slit in its width direction and forced out from the slit. As a preferable structure for the foregoing, the piston is in parallel with the slit, and a plane section having a length greater than a width of the slit is provided, which is preferable. It is preferable that the plane section forces in coating liquids contained in the coating liquid reservoir section, and forces out the coating liquids from the slit.

When a support to be coated with coating liquids is constant in thickness, and a coating thickness needs to be constant, it is preferable that the piston is pushed in at a constant speed. On the other hand, when a thickness of the support varies, and a coating thickness needs to be varied, it is preferable that the speed for pushing in the piston is changed depending on the variations.

It is further preferable that all coating liquids in the coating liquid reservoir section can be forced out through the slit by the piston. By employing this structure, it is possible to reduce an amount of loss of coating liquids.

It is preferable to apply a shearing speed (a shearing force or a grinding force) to coating liquids in the coating liquid reservoir section. It is especially preferable to apply a uniform shearing speed to coating liquids through the entire area of the slit in its width direction. In other words, it is preferable that a coating apparatus or a coater has a shearing speed applying means which applies a shearing speed that is uniform through the entire area of the slit in its width direction to coating liquids in the coating liquid reservoir section.

As a first example of the shearing speed applying means, there is given a rotary roller provided in the vicinity of a slit in the coating liquid reservoir section. The rotary roller has a length that is the same as or longer than that of the slit, and it is preferable that the rotary roller is provided to be in parallel with the slit. With regard to "the vicinity", 3 mm or less is preferable for the minimum distance between the rotary roller and an inner wall of the coating liquid reservoir section, a range from 10 $\mu$m to 1 mm is more preferable, and a range from 10 $\mu$m to 500 $\mu$m is still more preferable. Though a rotary roller may also be one rotated passively by the coating liquids forced out, a rotary roller that is forced to rotate in the prescribed direction by external driving force is preferable.

As a second example of the shearing speed applying means, there is given a supersonic irradiation device that radiates supersonic waves to coating liquids in the coating liquid reservoir section.

In a third example of the shearing speed applying means, it is possible to apply shearing speed to coating liquids by making a length in the direction of a short side of the slit (length in the direction perpendicular to the direction of the width) to be a prescribed length.

As a fourth example of the shearing speed applying means, there is given a circulation device that circulates coating liquids in the coating liquid reservoir section.

An extrusion type coating method, coating apparatus and a coater in the invention are especially suitable when coating liquids are represented by a liquid whose solid concentration is 20 vol % or more, preferably 50 vol % or more. Further, the extrusion type coating method may be applicable to a coating liquid having a viscosity of 1000 cps or more.

Though a capacity of the coating liquid reservoir section can be set freely, it is preferable that the capacity is in a range from 0.5 l to 100 l.

A coating apparatus may also be one having a plurality of coaters of the invention so that a plurality of layers may be coated. A plurality of coaters may be divided to be provided on an upstream side and a downstream side of a support in the direction of conveyance of the support, or plural coaters (preferably two coaters) may be superposed so that a plurality of layers may be coated simultaneously.

In the invention, there is assumed a use wherein coating is ended when all coating liquids injected in a coating liquid reservoir section are used up, and then, a piston is returned to its original position to inject coating liquids in the coating liquid reservoir section again when conducting next coating. Therefore, it is not assumed to use the coating apparatus of the invention for continuous coating on a support which is extremely long. However, it is also possible to employ an arrangement wherein plural coaters are used, and when coating liquids in a coater on one side are used up, a coater is switched to one on the other side, and coating liquids are injected in the emptied coater, so that continuous coating may be conducted.

The invention is related to an extrusion type coating apparatus and an extrusion type coating method which conduct continuous coating on a support, and the invention is characterized in that a mechanism called a pressurization ram that uniformalizes a coating thickness is provided and a mechanism to apply shearing speed to coating liquids uniformly immediately before coating can easily be mounted.

Due to the foregoing, when non-Newtonian properties in terms of liquid physical properties of a coating liquid is high, namely, when viscosity of a coating liquid is varied greatly depending on changes of shearing speed, a coating system of the invention is an effective one which can coat uniformly even in the case of a dispersive coating liquid having high solid concentration such as, for example, a stimulable phosphor plate.

As a coating apparatus, when a liquid conveyance system and a coating apparatus are united integrally, an amount of a loss of coating liquids in a coating liquid reservoir section can be made minimum. Namely, the coating apparatus is an extrusion type coating apparatus having a construction wherein a liquid conveyance system up to a coating coater are united solidly. It does not need structure of a coater chamber (coating liquid reservoir section) and a valve adjusting mechanism both matching liquid physical properties, which is different from a prior art, and it can coat accurately even when an amount of coating liquids in the coater chamber is reduced, because it employs a liquid conveyance system using a pressurization ram for forcing in liquid.

Therefore, the coating system of the invention can be applied to coating for production of products requiring coating liquids which are extremely expensive. For example, it can be applied to coating system for a disc support that is hard to a certain extent, such as a lithium-ion battery or a plasma display. It is also advantageous for manufacturing products of a type of many types in small-quantity production.

Typical examples of the invention will be explained as follows by comparing with a conventional coating apparatus. FIG. 1 is a structural diagram of an example of a conventional coating machine.

FIG. 1 shows a total construction wherein coater 1 includes coater chamber (coating liquid reservoir section) 3, slit section 4 and coater edge section 2, and FIG. 1(1) shows a diagram viewed when the coater 1 is cut at the position of the slit section 4, while FIG. 1(2) shows a side sectional view of the coater 1 viewed in the direction perpendicular to the diagram in FIG. 1(1).

Coating liquids 7 are conveyed through supply pipe 5 and supplied to coating liquid reservoir section 3 through an outlet located mostly at the center of a width of the coater 1. The coating liquid is conveyed from tank 8 in which coating liquids are stored after being prepared in the construction wherein, for that purpose, nitrogen gas is injected in the tank, and further, if necessary, coating liquid 7 is fed into the coater 1 by supply device 6 which is provided with a motor and is mounted on the half way of the supply pipe 5. Incidentally, F represents a filter.

Under this construction mentioned above, it is very difficult to feed out coating liquid 7 supplied to the coater 1 to coater edge section 2 at a constant rate in the direction of a width to be coated, and therefore, for example, an amount of liquid at a central portion is usually large and an amount at a peripheral portion becomes smaller as shown with arrows of coating liquid 7 in FIG. 1(1). This distribution of an amount of coating liquids naturally varies depending on characteristics of coating liquids, and it varies even on the half way of coating with a lapse of time, or it varies depending on the extent of stirring of coating liquids. Therefore, it is very difficult to control an amount of coating liquids to be constant.

It is therefore impossible to control fluctuations of coating thickness in the direction of a width to be coated and fluctuations which are caused with a lapse of time.

FIG. 2 is a structural diagram of an example of an extrusion type coating apparatus of the invention.

In the invention, there is provided pressurization ram 12 which can distribute coating liquids uniformly to slit section 4 as shown in FIG. 2(1) in spite of an extrusion type coating system. Due to the operations to push pressurization ram 12 covering entire length of a coater width in its direction into coater chamber (coating liquid reservoir section) 3 portion at a constant speed, it is possible to coat without being affected by physical properties of coating liquids at all. It is possible to obtain distribution of an amount of coating liquids which is uniform in the direction of a width, as shown in FIG. 2(2). It is naturally possible to obtain distribution of coating thickness which are perfectly uniform from the start of coating to the end of coating, and an amount of a loss of coating liquid is extremely small.

In the prior art, it is necessary to adjust the rate of aperture for a plurality of valves for distributing coating liquids in accordance with physical properties of the coating liquids. In the invention, however, it is possible to supply coating liquids totally uniformly on a support if pressurization ram 12 has only to be pushed in at a prescribed speed.

Further, since it is possible to apply shearing speed uniformly to coating liquids at clearance 13 between roll 11 that rotates immediately before coating and a wall surface, viscosity behavior of coating liquids can further be maintained to be uniform in the coating direction. Tolerance for viscosity of a coating liquid is very broad, and surface quality of a coated layer is extremely excellent. FIG. 2(3) is shown to illustrate this.

EXAMPLE

Next, structure and effect of the invention will be explained concretely as follows, referring to the example to which the invention is not limited.

By using an extrusion type coater of a unification type having a coating width of 500 mm wherein a diameter of an internal rotor is 200 mm, coating was carried out by adjusting the number of rotations so that shearing speed may be 5000 (1/sec).

In that case, coating was conducted on a polyethylene terephthalate support whose thickness is 200 $\mu$m, glass transition point (Tg) is 70° C. and a coefficient of thermal expansion is $8\times10^{-5}K^{-1}$.

In the coating liquid used, stimulable phosphor BaFI: $Eu^{2+}$ having mean particle diameter ○ 3 $\mu$m was used as dispersed products and polyester resin was used as a binder, and the rate (% by volume) of phosphor:resin was 85:15, and solid concentration was 80% by mass. Incidentally, a flow rate of the extrusion type coating apparatus was adjusted for coating so that a thickness of dried coating may be 350 $\mu$m. Viscosity of the coating liquid in this case was 5000 mPa·s (at the shearing speed of 100 mm·sec$^{-1}$).

Next, as a comparative example, the coating liquid which is the same as that in the example was coated to be the same layer thickness by using a conventional extrusion type coating machine (having the same construction as in the illustration in FIG. 1).

Comparison of Layer Thickness Distribution

A layer thickness of the coating sample prepared in the foregoing was measured by a contact type layer thickness meter, on 50 points in the direction of a 500 mm width.

The standard deviation of a distribution of the layer thicknesses measured was compared in terms of % as a deviation from a mean value of layer thicknesses.

| | Concentration distribution standard deviation (%) |
|---|---|
| Example | 0.52 |
| Comparative example | 3.05 |

As is apparent from the results stated above, it is understood that the standard deviation of the layer thickness distribution is extremely small and uniformity of layer thicknesses has been improved accordingly, when coating coating liquids containing dispersed products of the stimulable phosphor mentioned above by the use of a coater of a unification type.

Further, Ra was measured (cutoff 3.5 mm) for comparing surface roughness, resulting in the following,

| | Ra ($\mu$m) |
|---|---|
| Example | 3.0 |
| Comparative example | 12.0 |

which shows that surface roughness has also been improved remarkably.

The reason for the above is that a stress of high shearing speed can be applied to coating liquids immediately before coating.

Although there has been given explanation with an object to be coated concerning stimulable phosphors, as an example for the coating stated above, the system mentioned above is also effective for magnetic recording media, silver halide light-sensitive materials or other recording materials.

There is no restriction, in particular, even for a size of a coating apparatus, and coating widths ranging from about 50 mm to about 2000 mm can be realized.

Further, a viscosity range of coating liquids is extremely broad, and a range from 1.0 mpa·s to $1\times10^{6}$ mPa·s can be covered.

There is no restriction, in particular, even for a size of a portion (a reservoir section or a chamber section) of a coater of a unification type for storing coating liquids. In case of need, it is possible to provide an inlet through which coating liquids are introduced to the inside, a defoaming outlet through which a coating liquid is defoamed, a filter, a stirring blade capable of stirring inner coating liquid partially, and a supersonic dispersing apparatus.

The invention makes it possible to provide a coating method and a coating apparatus wherein a coating thickness is uniform, its dispersion width is small, an amount of a loss of coating liquids is extremely small, cost reduction is possible accordingly, a shearing speed can be applied to coating liquids immediately before coating, quality of coated surface can be excellent accordingly, and space saving can be attained because a coater section is of a unification type.

Disclosed embodiment can be varied by a skilled person without departing from the spirit and scope of the invention.

What is claimed is:

1. A coater to coat a coating liquid on a support, comprising:

a coater body including a liquid chamber which the coating liquid is fed and a slit through which the coating liquid is extruded from the liquid chamber onto the support so as to form a coating layer on the support, wherein the slit has a coating width corresponding to a width of the coating layer;

a piston having a piston head provided in the liquid chamber and shiftable in the liquid chamber so as to push the coating liquid toward the slit, wherein the piston head has a length substantially equal to the coating width of the slit so that the piston extrudes substantially an equal amount of the coating liquid over all the coating width of the slit; and a shearing speed applicator provided between the piston head and the slit in the liquid chamber and located adjacent to the slit, wherein the shearing speed applicator has a length substantially equal to the coating width of the slit so that the shearing speed applicator applies an equal shearing speed to the coating liquid all over the coating width of the slit, wherein the liquid chamber has a shiftable space in which the piston head shifts forwardly and backwardly and the shearing speed applicator is provided in the shiftable space so that the piston head is shiftable toward the shearing speed applicator, and wherein the piston head is curved so as to conform with a circular external shape of the shearing speed applicator.

2. The coater of claim 1, wherein the shearing speed applicator is a rotatable roller.

3. The coater of claim 2, wherein the liquid chamber has a wall communicating with the slit and the wall is curved so as to conform with the external shape of the rotatable roller.

4. The coater of claim 1, wherein the width of the piston head in a plane section is wider than the coating gap distance of the slit.

5. The coater of claim 1, wherein the piston can operate at a constant speed.

6. A coater to coat a coating liquid on a support, comprising:

a coater body including a liquid chamber into which the coating liquid is fed and a slit through which the coating liquid is extruded from the liquid chamber onto the support so as to form a coating layer on the support, wherein the slit has a coating width corresponding to a width of the coating layer;

a piston having a piston head provided in the liquid chamber and shiftable in the liquid chamber so as to push the coating liquid toward the slit, wherein the piston head has a length substantially equal to the coating width of the slit and is shaped to be substantially parallel to an inlet portion of the slit in a sectional plain view of the coater so that the piston extrudes substantially an equal amount of the coating liquid over all the coating width of the slit; and a shearing speed applicator provided between the piston head and the slit in the liquid chamber and located adjacent to the slit, wherein the shearing speed applicator has a length substantially equal to the coating width of the slit so that the shearing speed applicator applies an equal shearing speed to the coating liquid over all the coating width of the slit, wherein the liquid chamber has a shiftable space in which the piston head shifts forwardly and backwardly and the shearing speed applicator is provided in the shiftable space so that the piston head is shiftable towards the shearing speed applicator, and wherein the piston head is curved so as to conform with a circular external shape of the shearing speed applicator.

7. The coating of claim 6, wherein the leading edge line of the piston head in the sectional plain view of the coater is shaped in a straight line perpendicular to the flow direction of the extruded coating liquid.

* * * * *